United States Patent [19]

Prusman

[11] Patent Number: 4,662,073

[45] Date of Patent: May 5, 1987

[54] INFINITELY VARIABLE DRAWING INSTRUMENT

[76] Inventor: David Prusman, 138 Walgrove Ave., Dobbs Ferry, N.Y. 10522

[21] Appl. No.: 839,350

[22] Filed: Mar. 13, 1986

[51] Int. Cl.[4] ..... B43L 11/04

[52] U.S. Cl. ..... 33/27.11; 33/27.01

[58] Field of Search ..... 33/27.11, 23.01, 23.08, 33/23.04, 27.01, 32.4

[56] References Cited

U.S. PATENT DOCUMENTS

| | | | |
|---|---|---|---|
| 1,071,681 | 9/1913 | Allen | 33/27.01 |
| 3,820,245 | 6/1974 | Yozzo | 33/27.01 |
| 4,574,484 | 3/1986 | Borda | 33/27.11 |

OTHER PUBLICATIONS

"Mechanical Artist", Oct., 1942, p. 117; by Walter E. Burton.

*Primary Examiner*—Willis Little

*Attorney, Agent, or Firm*—Mandeville & Schweitzer

[57] ABSTRACT

An infinitely variable drawing instrument for producing unlimited varieties of fanciful designs. The designs produced by the drawing instrument are of the repeated individual line type yet indexed around the circumference of a circle. After the various apparatus variables are set by the operator and a piece of paper is located on a drawing platen, the drawing tool or pen nib, located at the end of a drawing bar connected to the driving wheel is placed on the paper and the operator merely rotates the driving wheel by grasping a handle. The simple manual rotation of the driving wheel causes the drawing platen to rotate and, in addition, causes the drawing tool or pen nib to move and thereby draw the fanciful design on the paper. Thus, repeated lines, indexed on a circle, produce unlimited drawing designs. A guiding template and/or an intermediate bar can also be connected between the driving wheel and the drawing bar which provide additional variables for adjustment for making additional drawing designs. The ratio of the number of turns of the driving wheel to the number of turns of the drawing platen can be adjusted to provide additional adjustable variables.

20 Claims, 8 Drawing Figures

INFINITELY VARIABLE DRAWING INSTRUMENT

BACKGROUND OF THE INVENTION

The present invention relates to fanciful designs and a drawing apparatus for producing them, particularly, but not exclusively for use by young persons. The drawing instrument produces a repetitive yet indexed series of patterns on a piece of paper, with the variety of patterns being infinitely variable. The present invention allows the user to first set up the drawing toy by adjusting various mechanical apparatus variables and then, by simply repeatedly turning a handle, a fanciful design consisting of a repetitive set of spaced-apart or indexed patterns is produced on a sheet of paper.

Drawing toys or instruments capable of producing an infinite variety of fanciful designs are relatively old in the art. These devices generally suffer from a variety of disadvantages. More specifically, the prior art drawing toys, in general, require that the user hold the drawing tool or pen nib in an aperture of a ring, disc or cam while simultaneously meshing the ring, disc or cam within a frame, another ring or a multi-lobed cam-shaped frame. The requirement for simultaneously holding the pen nib in the aperture and maintaining meshing engagement between the ring and the other apparatus element is relatively difficult and, without question, results in innumerable ruined drawings, especially when the drawing apparatus is used by small children with limited manual dexterity. It is, therefore, a specific object of the present invention to provide a drawing apparatus or toy which is capable of producing an infinite variety of repetitive yet indexed fanciful designs with manual dexterity being of limited importance. It is a further specific object of the present invention to have the drawing apparatus capable of being used even by the very smallest of children who can barely properly hold a writing instrument. All that is required, as will be more fully explained hereinafter, by the present invention, is the grasping of an upwardly extending handle and the repeated rotation of a driving wheel attached to the handle about the wheel's fixed rotational axis. Very small children, even if incapable of properly holding a writing or drawing instrument can, however, easily grasp a handle and cause it with its attached driving wheel to rotate about its fixed axis. Also, by taking the writing or drawing instrument "out" of the small child's hand, there is no chance for the child to write on the table top, walls or furniture. This, too, is clearly desirable. The present invention provides the ability to produce an infinite variety of designs which consist of repeated lines, either continuous or not, indexed with respect to one another. Clearly, this is extremely attractive to children and especially young children who previously either could not produce these drawings, ruined many drawings because of limited manual dexterity or produced the drawings only after great difficulty. Significantly, in addition, since it is no longer necessary to simultaneously hold the drawing tool or pen nib and maintain meshing engagement between the apertured disc or ring and the guiding frame or ring, ruined drawings will no longer occur. The present invention provides a drawing instrument which can produce an infinite variety of designs by simple manual rotation of a wheel.

DESCRIPTION OF THE PRIOR ART

U.S. Pat. No. 3,230,624 teaches a design instrument where a first ring member is provided with both internal and external gear-like teeth, while a wheel member is provided with matingly engageable exterior teeth. The wheel member is provided with a plurality of spirally located apertures through which the user's writing instrument is intended to pass, while simultaneously maintaining meshing contact between the wheel and the ring. In this manner, a fanciful design can be achieved consisting of repeated yet indexed, i.e., spaced apart curves. This is the basic "Spirograph" concept now manufactured and sold by Kenner Products of Cincinnati, Ohio, licensed under this reference. The device of the reference, however, as mentioned above, suffers from the inherent disadvantage of being difficult to use by children and especially small children. In addition, as mentioned, may ruined designs occur since it is extremely difficult to simultaneously hold the drawing tool in the desired aperture while simultaneously maintaining meshing engagement between the wheel and the ring. The present invention, as will be described hereinafter, overcomes these deficiencies. Also, the variables to be selected by the user of the spirograph are limited and the designs produced thereby also limited. This does not contribute to a toy of lasting fun. The present invention, on the other hand, has many elements which can be selectively adjusted to provide a toy of lasting fun and to produce an infinitely variable number of designs. Also, by giving the user different types of adjustment decisions, the final design product is not always known until after drawing is completed. The different types of adjustable elements generates more enjoyment for the user than simply selecting the aperture of the disc for holding the pen nib and the inside or outside meshing of the ring with the wheel.

U.S. Pat. No. 2,855,678 relates to a drawing apparatus for generating involutes, i.e., geometric curves. A stationary, semi-circular drawing board is provided with a center point designated by a pin. The paper upon which the desired curve is to be reproduced is attached to the drawing board. Adjacent to the drawing board is arranged a straight rail which is always maintained tangent to the drawing board's circumference, i.e., the rail is adapted to roll around the other periphery of the board. A guide rail containing a centrally located slot, constituting a longitudinal guideway, is provided. At the lower end of the slot, the center point pin is located, around which a rail pivots. On the straight rail a stationary pin is provided and projects through the slot of the guide rail and serves as a follower within the slot. A crossbar contains a central passage arranged to receive a slide. The slide is adjustably positioned with respect to the carriage and, yet, is rigidly maintained in the desired position by means of a threaded screw, mounted in the housing. At the end of the slide located in the slot of the rail is the drawing instrument or pen. The pen inscribes the involute curve on the surface of the board as the guide rail pivots. The device shown by this reference is capable of producing an infinite variety of involute curves by adjusting the fixed points of the rail member with respect to the guide rail and the slide. A simple manual turning of the rail member around the periphery of the disc results in the desired curve. However, it should be appreciated that this device for each setting of the apparatus variables only produces a single, closed involute curve and does not provide, in contrast to the present invention, an indexed series of repeated curves and irregular shapes. Also, the required simple wheel rotating movement of the present invention is easily able to be accomplished by a small child, whereas the device of the described patent requires a turning of a rail about the circumference of the disc to produce a single closed curve. A fanciful design of indexed curves is not the desired result of the device of the '678 patent.

U.S. Pat. No. 3,900,956 teaches an apparatus for drawing indexed, closed-line shapes. A disc, supported in a frame, is provided with a plurality of apertures or stencil cut-outs, which can be of any desired shape. The disc is provided, around its circumference, with ratchet teeth to enable the disc to be circumferentially shifted or indexed by shifting of the ratchet lever in its slot. Thus, a plurality of closed curves can be drawn, each indexed with respect to one another, about a centrally located point. In order to produce the indexed, closed curves or designs, it is necessary for the user to hold the drawing tool and to trace around the inside of the selected aperture. Again, this significantly precludes young children from playing with this toy, in that they are not really capable of properly holding a drawing instrument, let alone tracing around the inside of an aperture. It should be appreciated that the present invention allows a young child to easily produce a fanciful design consisting of a plurality of repeated, i.e., indexed lines. Also, the present invention offers a degree of excitement for the user in that he does not necessarily know until the design is actually produced, the final design. Here, again, this must be contrasted with the device of the '956 patent.

U.S. Pat. No. 3,465,445 shows a frame provided with a plurality of preferably transparent rings. The rings are provided with a plurality of holes, spirally arranged around each ring. According to the specification, by holding a particular ring against the edge of the frame and rolling the ring around the inside edge of the frame, with a pen simultaneously located in a selected hole, a plurality of fanciful drawings can be made. Other ways of using the apparatus are also disclosed in the reference. Again, however, use of the device requires a degree of manual dexterity, not necessarily obtained by small children. The '445 device does not, in any event, provide the degree of design variety which the present invention provides nor does it provide the user with the number and variety of adjustable variables, all of which, too, adds to the enjoyment of the present drawing apparatus.

U.S. Pat. No. 4,391,045 shows a drawing apparatus which includes a frame member having a central, multilobed cam-shaped aperture serving to locate a multilobed, cam-shaped disc-like member. The disc, itself, is provided with stencil-shaped openings. Use of this apparatus results in indexed drawing designs. Again, however, the use of the device by an individual is far more difficult than the simple handle rotation or turning contemplated by the invention disclosed herein. More specifically according to the drawing instrument of the '045 patent, a pen is maintained in the selected hole while the disc's cam projection is simultaneously maintained in the lobe of the frame, to thereby create a drawing. Here, again, this appears to be rather difficult for a child having limited manual dexterity and, again, does not offer the number or variety of variables for selection by the user.

It is an object of the present invention to provide a drawing toy which provides for an infinite number of design drawings to be made by use of the toy and, further, allows the user to adjust various mechanical elements of the toy, prior to using the toy. This, also, contributes to the fun and enjoyment of using the toy. In addition, since the mechanical elements of the present drawing device can be adjusted and, yet, to small children their interrelationship is difficult to appreciate, it is difficult to predict the precise drawing which will be made by use of the present apparatus. This, also, contributes to the fun and enjoyment in using the toy.

U.S. Pat. No. 157,841 shows a drawing instrument like a mechanical drafting compass. This device is intended to provide a spiral line on a sheet of paper. As best seen in the drawing of this reference, rotation of the top knob causes the drawing pen to revolve around the vertical support axis, and, simultaneously, causes the radius of the otherwise scribed circle to constantly decrease, thereby resulting in the drawn spiral.

U.S. Pat. No. 3,872,595 relates to an apparatus for tracing, one time only, i.e., non-indexed, a non-circular template. This reference is of little direct relevance to the drawing device of the present specification, yet it does show an endless chain or string which seems to turn a drive pulley having attached thereto a pantograph-type device located at the end of a lever arm. The device of the '595 patent, however, is specifically for the purpose of tracing a non-circular template and does not provide a series of indexed fanciful designs, nor is there any showing of the ease of use of this device by a child. Indeed, it clearly appears that the device is intended to be machine run and is not a drawing instrument, at all.

U.S. Pat. No. 1,349,455 and U.S. Pat. No. 2,190,071 relate to drawing instruments of general background interest.

SUMMARY OF THE INVENTION

The present invention relates to a drawing instrument which is capable of producing an infinite variety of artistic designs consisting of either continuous or discontinuous yet indexed curved lines. Basically, the first embodiment of the present invention comprises a driving wheel having an upwardly extending handle projecting therefrom. The driving wheel is rotatable about a center point by turning the handle. A drawing platen, also circular, is rotatable about a centrally located axis. The rotation of the driving wheel is mechanically connected to rotation of the drawing platen, such that rotation of the handle causes the drawing platen, with a piece of paper located on the top thereof, to correspondingly rotate. Connected to the driving wheel is a drawing bar which has, at its distal end, i.e., the end not connected to movement of the driving wheel, an aperture for holding a drawing tool or a pen nib. This drawing tool is supported by the drawing platen and, when the handle of the driving wheel is rotated, causing the driving wheel and correspondingly the drawing platen to rotate, a fanciful drawing is created on the surface of the paper by the movement of the drawing bar. Of course, to provide a variety of drawing designs, the drawing bar is provided with at least two positions or orientations for connection with the driving wheel, so that at least two designs can be generated by the drawing apparatus.

In the preferred embodiment of the present invention, a guiding template is secured to the driving wheel and provides a plurality of apertures for selective connection of the drawing bar. In addition, the guiding template is provided with an irregularly shaped slot through which a nail or peg can be secured into the support table of the drawing instrument to limit or alter the motion of the guiding template and the drawing bar. The location of the nail through the slot of the guiding template and selection of the hole of the guiding template in which the drawing bar is located provide additional variables which contribute to the fun of the drawing toy. Also, all of the variables change the ultimate drawing designed on the paper. Also, in the preferred embodiment, an intermediate bar is connected between the guiding template and the drawing bar. One end of this intermediate bar is selectively located in any one of the holes of the guiding template. The intermediate bar is provided with a slot extending substantially along the entire length of the bar. The drawing bar can also be provided with a longitudinally extending slot. A connecting pin in the form of a bolt and nut can be inserted through the longitudinal slot of the drawing bar and through the longitudinal slot of the intermediate bar and the angular position and lengthwise adjustment of the drawing bar with respect to the intermediate bar can be selectively adjusted, to again provide additional variables to be adjusted.

In the preferred embodiment of the present invention, the rotation of the driving wheel is connected to rotation of the drawing platen by an elastic endless belt or band which travels in circumferential grooves of the driving wheel and drawing platen. Alternatively, however, it should be appreciated that the driving connection between the driving wheel and the drawing platen can take the form of gear teeth located circumferentially around the respective elements and an endless chain interconnecting the driving wheel and the drawing platen. In an alternate embodiment of the driving connection between the driving wheel and the drawing plante, the respective elements can be provided with circumferential gear teeth with an intermediate gear or gears located between the driving wheel and drawing platen, such that rotation of the driving wheel by turning the handle will result in rotation of the drawing platen. It is a specific feature of this embodiment that the intermediate gear and the driving wheel can be replaced, in pairs, so that the ratio of the number of turns of the driving wheel to the number of turns of the drawing platen can be selectively adjusted. This provides yet another variable to be selected by the user and results in additional drawing designs.

In yet another embodiment of the driving connection between the driving wheel and the drawing platen, the driving wheel is provided with a series of radially stepped, circumferential grooves which are individually capable of selectively receiving an elastic endless band. The band passes over the circumferential groove of the drawing platen. This, too, provides the user of the drawing apparatus with another variable to adjust prior to use and a means for changing the ratio of the number of turns of the driving wheel to the number of turns of the drawing platen.

DETAILED DESCRIPTION OF THE DRAWINGS

Figure 1:
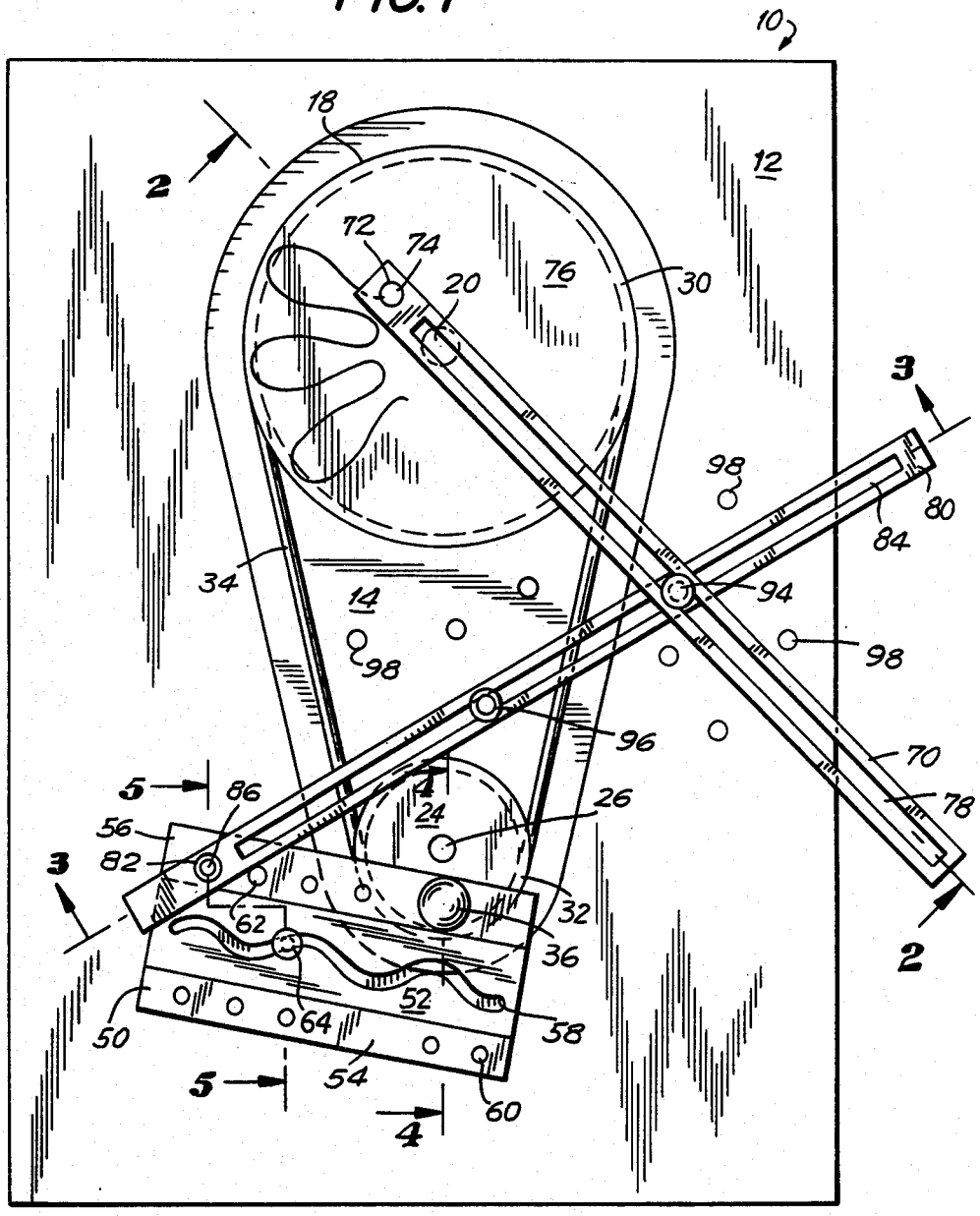
FIG. 1 is a top plan view of the preferred embodiment of the present invention.

The drawing toy or instrument is generally referred to by numeral 10. Basically, it comprises a support table 12 which has a cut-out or recessed area 14. A drawing platen 18, in the preferred embodiment, comprising a circular disc, is located in the cut-out area 14. A peg 20, centrally located and secured to drawing platen 18 is secured in a hole 22 of the support table 12 and allows drawing platen 18 to rotate. A driving wheel 24, in the preferred embodiment, being of a smaller diameter than drawing platen 18 is also circular in shape and located within recessed cut-out area 14 in the support table 12. The driving wheel 24 is provided with a centrally located peg 26 which is adapted to be received within hole 28 of the support table 12. Preferably, the top surface 16 of support table 12 is flush with the top surfaces of the drawing platen 18 and the driving wheel 24. In a first embodiment of the present invention, the drawing plate 18 and the driving wheel 24 are both provided with circumferential grooves 30 and 32, respectively, which maintain and guide an endless band 34 in the form of a round cable.

Figures 2, 3, 4, 5:
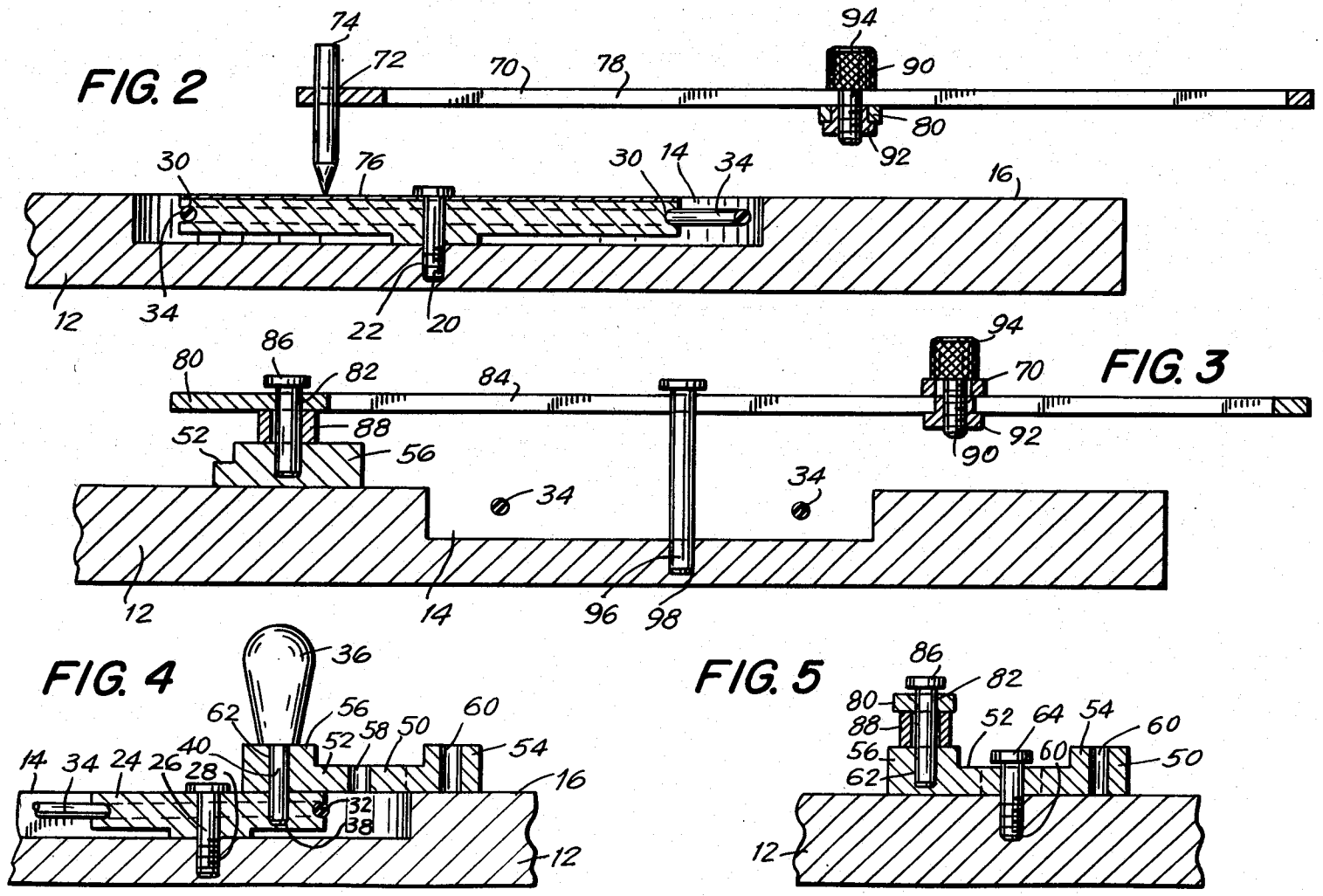
FIG. 2 is a cross sectional view taken along lines 2—2 of FIG. 1.
FIG. 3 is a cross sectional view taken along lines 3—3 of FIG. 1.
FIG. 4 is a cross sectional view taken along lines 4—4 of FIG. 1.
FIG. 5 is a cross sectional view taken along lines 5—5 of FIG. 1.

A handle 36 extends upwardly from the top surface of driving wheel 24 and is maintained within a hole 38 located in driving wheel 24. It will be thus appreciated that manual grasping of handle 36 and rotation of driving wheel 24 about peg 26 causes drawing platen 18 to correspondingly rotate about pivot point or peg 20 (see FIGS. 2 and 4). The handle 36 is provided with a rod extension 40 which, in a manner which will be described hereinafter, passes through a selected hole or aperture of guiding template 50 and then is located within hole 38 of driving wheel 24.

A guiding template 50, in the preferred embodiment, having a U-shaped cross section (see FIGS. 4 and 5) has a flat base portion 52 and a pair of upwardly extending legs 54 and 56. Passing through the base portion 52 of guiding template 50 is a groove 58 which, in the preferred embodiment, has an irregular curved shape. Upwardly extending leg 54 is provided with a plurality of hole which are spaced apart from one another and upwardly extending leg 56 is also provided with a series of spaced-apart holes 62. The rod extension 40 is capable of being selectively passed through any of the holes 60 or 62, completely through guiding template 50 and the down into hole 38 of driving wheel 24. A peg 64 is selectively passed through groove 58 at a desired location and secured in a hole 66, located in support table 12. A plurality of holes 66 are provided for selective location of peg 64 in support table 12. The peg 64 when located within any of the selected holes 66 will, in a manner to be described hereinafter, limit or alter the movement of the guiding template when the handle 36 is rotated.

A drawing bar 70 is provided at its first or distal end with a hole 72 for selective receipt of a drawing tool or pen nib 74 which, when a piece of paper 76 is located on the top surface of drawing platen 18 creates the spaced, repeated lines for the desired drawing. The bar 70 is provided with a longitudinal slot 78.

An intermediate bar 80 is provided with a hole 82 at a first end and a longitudinally extending slot 84. A peg 86 is adapted to connect intermediate bar 80 to guiding template 50 by passing the peg 86 through the hole 82 of intermediate bar 80, through a spacing washer 88 and then into any one of holes 60 or 62 of the guiding template 50. Drawing bar 70 is angularly and lengthwise adjustable with respect to intermediate bar 80 by a bolt and washer mechanism 90 and 92, respectively. Bolt 90 is provided with a knurled turning head 94 to facilitate the tightening and untightening of the connection between drawing bar 70 and intermediate bar 80. A peg 96 is adapted to pass through longitudinal slot 84 of intermediate bar 80 and is capable of being located in any one of a plurality of holes 98, located either in the cut-out area 14 or the top surface 16 of support table 12. This peg 96 serves to limit or alter the movement of intermediate bar 80 with respect to rotation of driving wheel 24 and, consequently, in a manner which will be explained hereinafter, limits or alters the movement of drawing bar 70 and drawing tool 74.

Prior to operation of the drawing instrument, it is necessary to first select and adjust the various mechanical members, as desired. In this connection, the rod extension 40 of handle 36 is passed through any one of a select holes of either set 60 or 62 of guiding template 50 and the rod is then located in hole 38 of the driving wheel 24. Then, peg 86 is passed through hole 82 of intermediate bar 80 and its end is then located within any one of the spaced holes 60 or 62 or guiding template 50. Drawing bar 70 is then both angularly and lengthwise adjusted with respect to intermediate bar 80 and once the position is determined, the knurled head 94 of bolt 90 is turned so as to tigthen bolt 90 onto nut 92, to thereby secure in relative position intermediate bar 80 and drawing bar 70. It should be appreciated that it is desirable that the adjustment of drawing bar 70 with respect to intermediate bar 80 be such that the drawing tool or pen nib 74 be, at least initially, located on the paper located on the top surface of the drawing platen 18.

A piece of paper 76, preferably circular, is secured to the top surface of drawing platen 18. In this connection, either retaining clips can be provided for securing the paper in place or, alternatively, the underside surface of the paper can be temporarily affixed to the top surface of the drawing platen by glue or other temporary adhesive. In this connection, it is noted that the paper can be provided, preferably, with the type of temporary adhesive currently in use in "Post-it" notes now being manufactured and distributed by The 3M Company of Minneapolis, Minn.

If desired, although not necessary, peg 96 can be slid through slot 84 of intermediate bar 80 and frictionally secured with any one of selected holes 98 located in the support table 12. Also, although not required, it is desirable to pass peg 64 through the groove 58 of guiding template 50, with the end of peg 64 being located in any one of a selected series of holes 66 in the support table 12. With the apparatus set-up as just described, it is now ready to be used.

In use, the individual merely grasps the upwardly extending handle 36 and rotates the driving wheel 24. Rotation of driving wheel 24 causes drawing platen 18, with paper 76 attached thereto, to correspondingly rotate. In addition, rotation of driving wheel 24 causes movement of guiding template 50, intermediate bar 80 and drawing bar 70, with the drawing tool or pen nib 74 located at its end. Therefore, a fanciful design is created on the paper 76 which, by virtue of the drawing platen 18 being rotated consists of spaced and repeated sets of lines either continuous or discontinuous. Pegs 64 and 96 serve to limit or alter the motion of the guiding template 50 and intermediate bar 80, respectivley. If desired, these two pegs can be eliminated.

It should be appreciated that the following variables can be selectively altered, the holes 60 or 62 through which rod 40 of handle 36 passes, for securing the handle into driving wheel 24, the holes 60 or 62 for peg 86 for locating intermediate bar 80, the angular and lengthwise adjustability of drawing bar 70 with respect to intermediate bar 80 and the location of pegs 64 and 96 within the holes located on various portions of the support table 12. All together these variables create unlimited flexibility and an infinite variety of drawings which will comprise a series of repeated, i.e., indexed patterns. The apparatus is used by turning handle 36 on driving wheel 24 until the desired design is created and then, the knurled head 94 of bolt 90 is turned, counterclockwise, to loosen drawing bar 70 from intermediate bar 80, such that the end of drawing bar 70 having the drawing tool or pen nib 74 is moved off of the paper 76, and the paper 76 is then removed.

Figure 6:
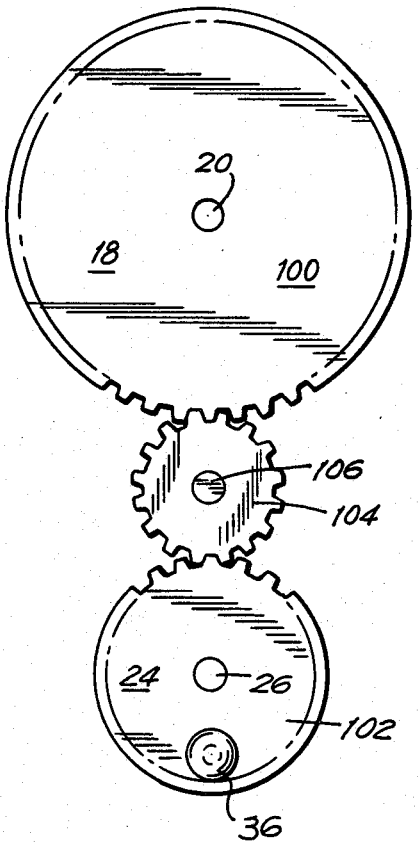
FIGS. 6 and 7 show a second embodiment of the driving connection between the turning wheel and drawing platen of the present invention with the driving wheel and intermediate gear being replaceable in pairs.
Figure 7:
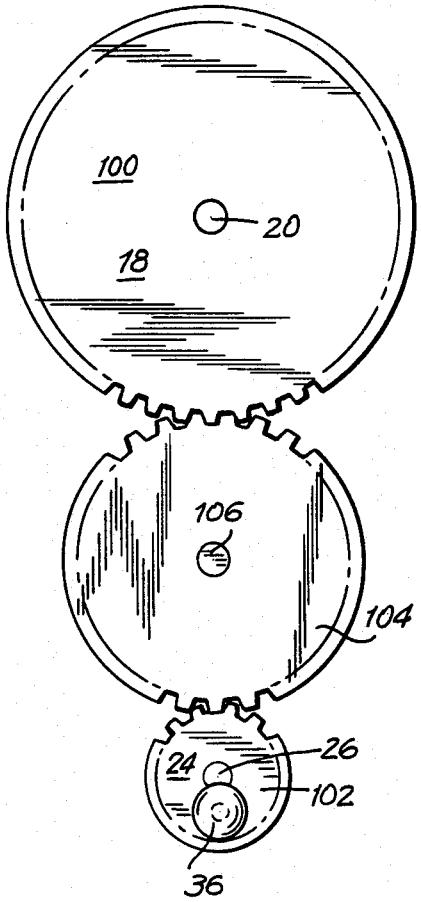

It should be appreciated that the embodiment of the invention disclosed by FIGS. 1–5 shows that for each 360° rotation of the driving wheel, the drawing platen will rotate a number of degrees equal to $360 \times r/R$ where r is the radius of the driving wheel and R is the radius of the drawing platen. It is yet another aspect of the present invention to utilize a different mechanism for transmitting the circular rotation of driving wheel 24 to rotation of the drawing platen 18 and to then be able to change the turning ratio of the number of turns of the driving wheel to the number of rotations or fractions thereof of the drawing platen. In the embodiment of the present invention shown in FIGS. 6 and 7, drawing platen 18 is in the form of a gear 100 and driving wheel 24 is also in the form of a gear 102. An intermediate gear 104 meshingly engages with both gears 102 and 100 and serves to transmit, once again, the rotational turning of driving wheel 24 to rotation of drawing platen 18. In this embodiment of the invention, shown in FIGS. 6 and 7, the drawing platen 18 is rotatable about peg 20 which is secured in hole 22, located in cut-out area 14 of support table 12. Also, driving wheel 24 is rotatably secured in cut-out area 14 of support table 12 by peg 26. Intermediate gear 104 is rotatable about peg 106, located at its center, and being secured within a hole 108 (not shown), located in cut-out area 14 of support table 12. Not only is the gear arrangement shown in FIGS. 6 and 7 capable of transmitting the rotational motion of the driving wheel 24 to the drawing platen 18, but, in addition, this manner of transmitting the motion provides flexibility to the drawing apparatus which is not available by use of the endless belt driving means shown in FIG. 1. According to the embodiment shown in FIGS. 6 and 7, the driving wheel 24 in the form of gear 102 and the intermediate gear 104 can be replaced, in pairs, to thereby selectively change the turning ratio between the number of turns of the driving wheel 24 and the number of turns of the drawing platen 18. Two sets of driving wheels 24 in the form of gears 102 and intermediate gears 104 are shown in FIGS. 6 and 7. By changing gears 102 and intermediate gears 104, in pairs, different turning ratios can be used resulting in different drawing designs. To accommodate the selective placement of pairs of driving wheels 24 and associated intermediate gears 104, the cut-out area 14 of support table 12 should be provided with a plurality of holes for selective receipt of pegs 106 and 26. Thus, it should be appreciated that the number of turns of the driving wheel 24 which produce a given number of turns of the drawing platen 18, can be selectively adjusted which, consequently, will, once again, provide a degree of choice to the user of the apparatus and, therefore, create another variable to be adjusted prior to use.

Figure 8:
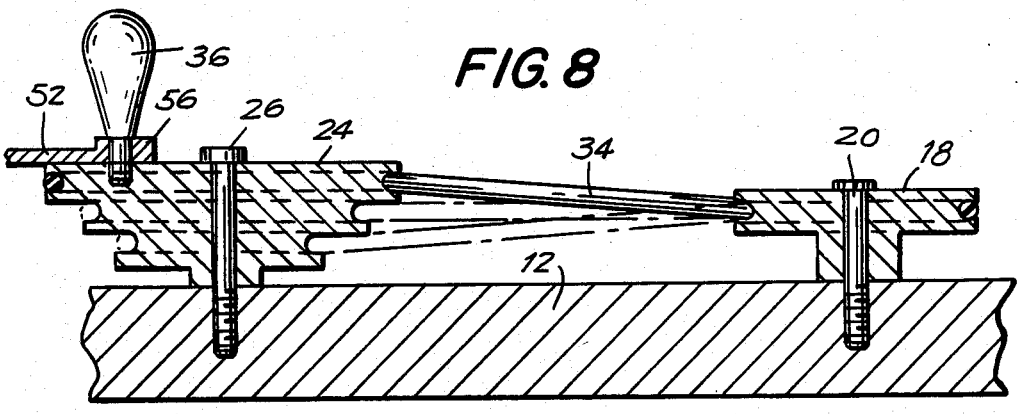
FIG. 8 is a third embodiment of the driving connection between the turning wheel and the drawing platen of the present invention.

FIG. 8 is yet another embodiment of the present invention and, again, relates to the mechanism for transmitting the manual rotation of driving wheel 24 to result in rotation of drawing platen 18. This embodiment uses an endless elastic band 34, housed in annular grooves circumferentially located on both the driving wheel 24 and the drawing platen 18. In this embodiment, however, the driving wheel 24 comprises a radially stepped-down, series of circumferential grooves having decreasingly varying radii. The endless band 34 is truly elastic, so that any one of the circumferential grooves of driving wheel 24 can be selected and the endless elastic band can be located in that selected groove, to thereby selectively vary the ratio of rotations between the driving wheel and the drawing platen.

It should be understood, of course, that the specific form of the invention herein illustrated and described is intended to be representative only, as certain changes may be made therein without departing from the clear teachings of the disclosure. Accordingly, reference should be made to the following appended claims in determining the full scope of the invention.

I claim:

1. An instrument for mechanically producing a variety of indexed drawings onto a piece of paper comprising:

(a) a drawing platen for supporting a piece of paper, said drawing platen being rotatably secured on a support table;

(b) a wheel having a handle, said wheel also being rotatably secured on said support table;

(c) a driving means for mechanically connecting manual rotation of said wheel, by said handle, to rotation of said drawing platen;

(d) turning ratio changing means for selectively changing the rotational turning ratio between said wheel and said drawing platen;

(e) a drawing means comprising a drawing bar having a first end mechanically interconnected to said wheel at any one of a selected plurality of positions; and (f) said drawing bar having a second end provided with a drawing tool supported on a piece of paper held on said drawing platen.

2. An instrument as claimed in claim 1, wherein:

(a) said wheel and said drawing platen are each provided with a circumferential groove; and (b) said driving means comprises an endless belt located in said circumferential grooves.

3. An instrument as claimed in claim 1, wherein:

(a) said drawing platen is a first gear;

(b) said wheel is a second gear; and (c) said driving means is a third gear meshingly engaged by said first gear and said second gear.

4. An instrument as claimed in claim 1, wherein:

(a) said drawing platen is a first gear;

(b) said wheel is a second gear;

(c) said driving means is a gear meshingly engaged by said first gear and said second gear; and (d) said turning ratio changing means comprises said second gear and said intermediate gear being replaceable in associated pairs with the radii of said second gears being different from one another.

5. An instrument as claimed in claim 2, wherein:

(a) said wheel comprises at least two circumferential grooves of different radii; and (b) said endless band is elastic and capable of being housed in any of said circumferential grooves of said wheel and said circumferential groove of said drawing platen such that the turning ratio between said wheel and said drawing platen is selectively changed.

6. An instrument as claimed in claim 1, wherein said drawing means further comprises a guiding template connected between said wheel and said drawing bar; said guiding template having a guiding groove for receipt of a template nail into said support table to thereby limit movement of said guiding template and said drawing bar in response to rotation of said wheel.

7. An instrument as claimed in claim 6, wherein said guiding template is adjustably secured to said wheel by said handle.

8. An instrument as claimed in claim 6, wherein said guiding template is adjustably secured to said wheel.

9. An instrument as claimed in claim 6, wherein said drawing bar is adjustably connected to said guiding template.

10. An instrument as claimed in claim 6, further comprising an intermediate bar connected between said guiding template and said drawing bar.

11. An instrument as claimed in claim 10, wherein said intermediate bar is adjustably secured to said guiding template.

12. An instrument as claimed in claim 10, wherein said drawing bar is angularly and lengthwise adjustable with respect to said intermediate bar.

13. An instrument as claimed in claim 10, wherein said intermediate bar is provided with a slot for selective receipt of a bar movement limiting nail into said support table to thereby limit movement of said intermediate bar and said drawing bar in response to rotation of said wheel.

14. An instrument as claimed in claim 12, wherein said drawing bar and said intermediate bars are provided with longitudinal slots and a connecting means passes through said longitudinal slots for securing said drawing bar and said intermediate bar in relative position with respect to one another.

15. An instrument as claimed in claim 6, wherein said guiding template is provided with a series of spaced holes for facilitating selective adjustable connection between said wheel and said drawing bar to said guiding template.

16. An instrument as claimed in claim 6, wherein said support table is provided with a plurality of holes for receipt of said template nail.

17. An instrument as claimed in claim 13, wherein said support table is provided with a plurality of holes for receipt of said bar movement limiting nail.

18. An instrument as claimed in claim 6, wherein:

(a) said guiding template is U-shaped with said guiding groove passing through the base of said U; and (b) said legs of said U extend upwardly above said template nail.

19. An instrument as claimed in claim 1, wherein said wheel and said drawing platen are recessed into a shaped hole of said support table.

20. An instrument as claimed in claim 19, wherein the top surface of said drawing platen is flush with the top surface of said support table.

* * * * *